US011571905B2

(12) United States Patent
Koizumi

(10) Patent No.: US 11,571,905 B2
(45) Date of Patent: Feb. 7, 2023

(54) INK SUPPLY BOTTLE

(71) Applicant: SEIKO EPSON CORPORATION, Tokyo (JP)

(72) Inventor: Yoshihiro Koizumi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/366,291

(22) Filed: Jul. 2, 2021

(65) Prior Publication Data

US 2022/0001671 A1 Jan. 6, 2022

(30) Foreign Application Priority Data

Jul. 3, 2020 (JP) ..... JP2020-115317

(51) Int. Cl.
*B41J 2/175* (2006.01)

(52) U.S. Cl.
CPC ..... *B41J 2/17513* (2013.01); *B41J 2/17523* (2013.01); *B41J 2002/17516* (2013.01)

(58) Field of Classification Search
CPC ..... B41J 2/17513; B41J 2/17523; B41J 2002/17516; B41J 2/17509; B41J 2/1754; B41J 2/17553; B41J 29/13; B41J 2/17596; B41J 2/17506
USPC ..... 347/86
See application file for complete search history.

(56) References Cited

U.S. PATENT DOCUMENTS 4,183,031 A * 1/1980 Kyser ..... B41J 2/1752 101/366
6,158,853 A * 12/2000 Olsen ..... B41J 2/17513 347/86
6,402,309 B1 * 6/2002 Litman ..... B41J 2/17513 347/86
2018/0207939 A1 7/2018 Ishizawa et al.
2020/0139716 A1 5/2020 Ishizawa et al.

FOREIGN PATENT DOCUMENTS

JP 2018-118453 A 8/2018

* cited by examiner

*Primary Examiner* — Kristal Feggins
*Assistant Examiner* — Alexander D Shenderov
(74) *Attorney, Agent, or Firm* — Oliff PLC

(57) ABSTRACT

An ink supply bottle from which ink is to be supplied to a printer includes: an ink bag that contains the ink; a bottle unit that houses the ink bag and that has a bottleneck with an exit opening; and an ink conduit member disposed in the bottleneck of the bottle. The ink conduit member is in contact with an inner side of the ink bag and seals an opening of the ink bag to form an ink outlet. The ink bag is made of an elastic or stretchable material.

7 Claims, 8 Drawing Sheets

INK SUPPLY BOTTLE

The present application is based on, and claims priority from JP Application Serial Number 2020-115317, filed Jul. 3, 2020, the disclosure of which is hereby incorporated by reference herein in its entirety.

BACKGROUND

1. Technical Field

The present disclosure relates to an ink supply bottle.

2. Related Art

Ink jet printers are one known example of ink ejecting apparatuses, in which a print head discharges ink onto a print paper or other print medium to print predetermined information thereon. Some of such ink jet printers employ a refillable type in which ink can be refilled in an ink tank through an ink bottle (e.g., refer to JP-A-2018-118453).

The above ink bottle may be difficult to reuse due to adherence of the ink to all its components. Therefore, ink bottles can be reused only in limited applications, otherwise all the components are discarded.

SUMMARY

The present disclosure is an ink supply bottle from which ink is to be supplied to a printer. This ink supply bottle includes: an ink bag that contains the ink; a bottle unit that houses the ink bag and that has a bottleneck with an exit opening; and an ink conduit member disposed in the bottleneck of the bottle. The ink conduit member is in contact with an inner side of the ink bag and seals an opening of the ink bag to form an ink outlet. The ink bag is made of an elastic or stretchable material.

DESCRIPTION OF EXEMPLARY EMBODIMENTS

A. First Embodiment

Figure 1:
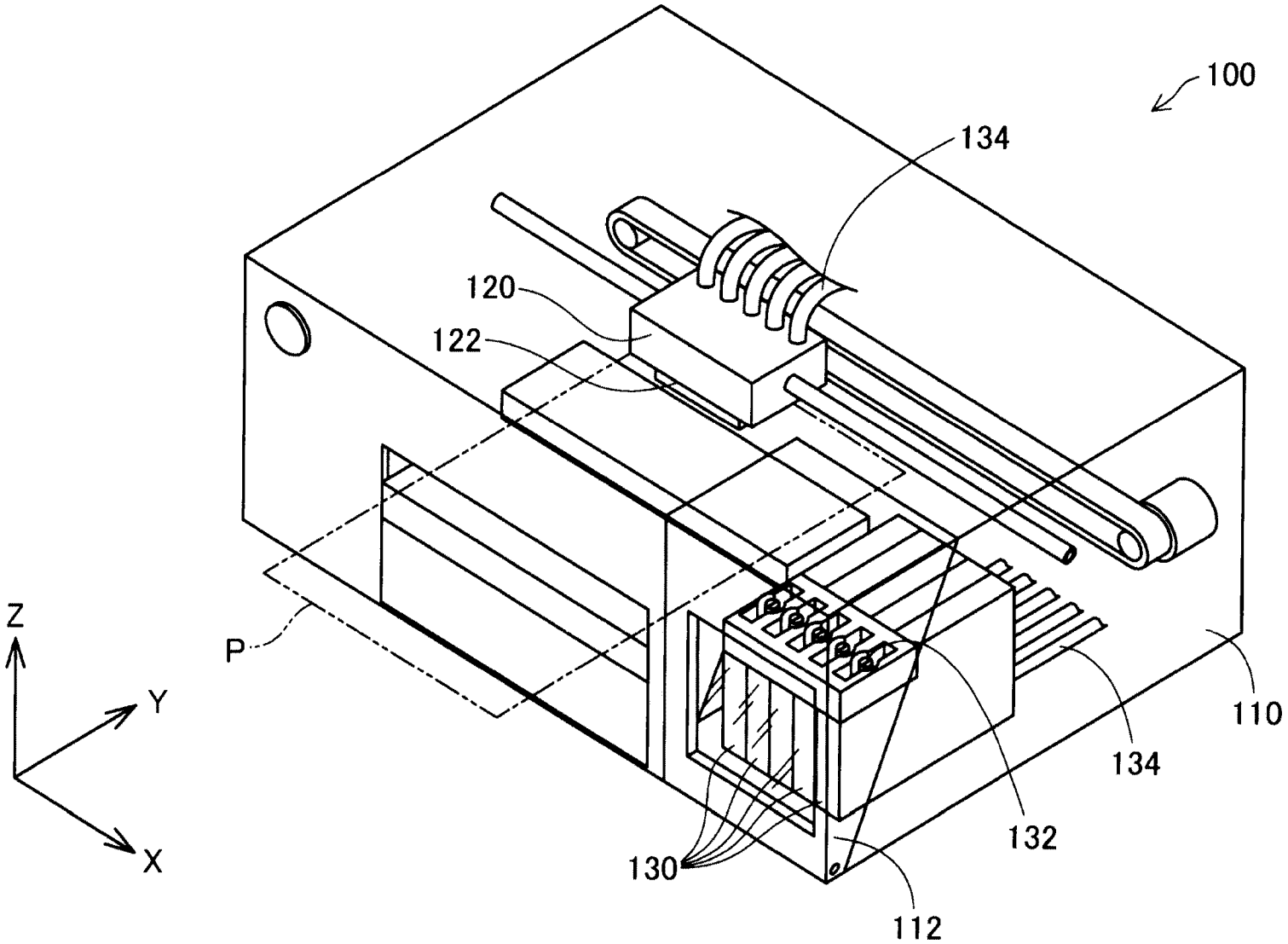
FIG. 1 is a perspective view of a printer to which ink is to be supplied through an ink supply bottle according to a first embodiment of the present disclosure.

FIG. 1 is a perspective view of a printer 100. The printer 100 can be supplied with ink through an ink supply bottle or container 200 (see FIG. 2) according to a first embodiment of the present disclosure. The printer 100 may be an ink jet printer that discharges the ink to a print medium P to print predetermined information thereon. FIG. 1 illustrates three axes orthogonal to one another: an X-axis extends along the width of the printer 100; a Y-axis extends along the depth of the printer 100; and a Z-axis extends along the height of the printer 100. The printer 100 is usually placed in a horizontal plane defined by the X- and Y-axes. Herein, the direction of the arrow of the X-axis is referred to below as the +X direction, whereas its opposite direction is referred to as the −X direction. Likewise, the direction of the arrow of the Y-axis is referred to as the +Y direction, whereas its opposite direction is referred to as the −Y direction. The direction of the arrow of the Z-axis is referred to as the +Z direction, whereas its opposite direction is referred to as the −Z direction.

The printer 100 includes a casing 110 in which a carriage 120 moves in a main scanning direction, or in the ±X directions. Disposed on the lower surface of the carriage 120 is a print head 122 that discharges the inks to the print medium P. As viewed from the +Y direction, a cover 112 is pivotally disposed in a right front portion of the front surface of the casing 110. Arranged opposite the inner side of the cover 112 are a plurality of ink tanks 130.

The plurality of ink tanks 130 are all coupled to the print head 122 on the carriage 120 via respective tubes 134 so that the inks can be supplied from the ink tanks 130 to the print head 122. Herein, each ink tank 130 employs a refillable type. The upper surface of each ink tank 130 is provided with an ink-passage-inlet member 132 having a cylindrical shape via which the ink is to be refilled. It should be noted that each ink tank 130 is of a stationary type and thus it is not disposed on the carriage 120. The front surface of each ink tank 130 has a light-transmissive member so that a user can visually check the amount of ink left from the outside. When only a small amount of ink is left in an ink tank 130, the user can open the cover 112 and refill the ink in the ink tank 130 via the ink-passage-inlet member 132.

Herein, the expression "supply ink to an ink tank" implies the process of refilling ink in an ink tank 130 in order to increase the ink amount. This process does not necessarily have to be performed until the ink tank 130 has been filled up. It may also imply the process of filling ink into an empty ink tank 130 prior to the initial operation of the printer 100.

Figure 2:
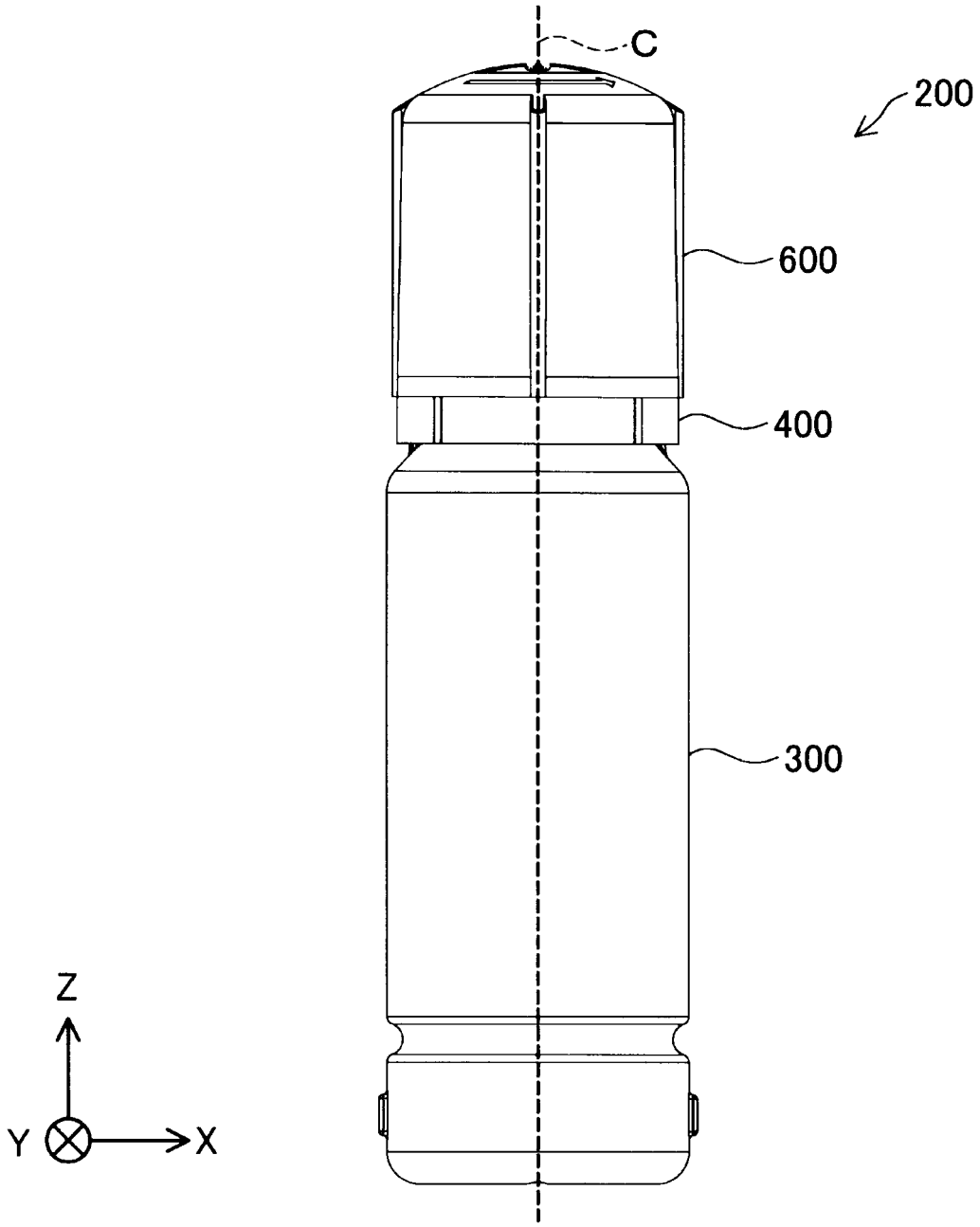
FIG. 2 is a front view of an ink supply bottle in a regular posture before use.

FIG. 2 is a front view of an ink supply bottle 200 in a regular position. This regular posture implies the state where the ink supply bottle 200 is placed on a horizontal plane, such as a desk, with the bottom of the bottle body 300 facing downward. When in the regular posture, the upper end of the ink supply bottle 200 is defined as the end, whereas the lower end thereof is defined as the bottom. In FIGS. 2 to 8, the +Z direction corresponds to the direction toward the end of the ink supply bottle 200 in the regular posture. In FIG. 2, the broken line corresponds to a central axis C of the ink supply bottle 200. Herein, the direction parallel to the central axis C of the ink supply bottle 200 is referred to as the axial directions, whereas the direction vertical to the central axis C is referred to as the radial directions. Further, one of the radial directions from the inside of the ink supply bottle 200 to the outside is defined as the outer radial direction, whereas its opposite direction is defined as the inner radial direction.

The ink supply bottle 200 includes: a bottle body 300 that houses an ink bag 310 containing the ink; an ink conduit member 400 that forms an ink outlet 415; and a cap 600 removably attached to the end of the ink conduit member 400. Details of the ink bag 310 and the ink outlet 415 will be described later.

Figure 3:
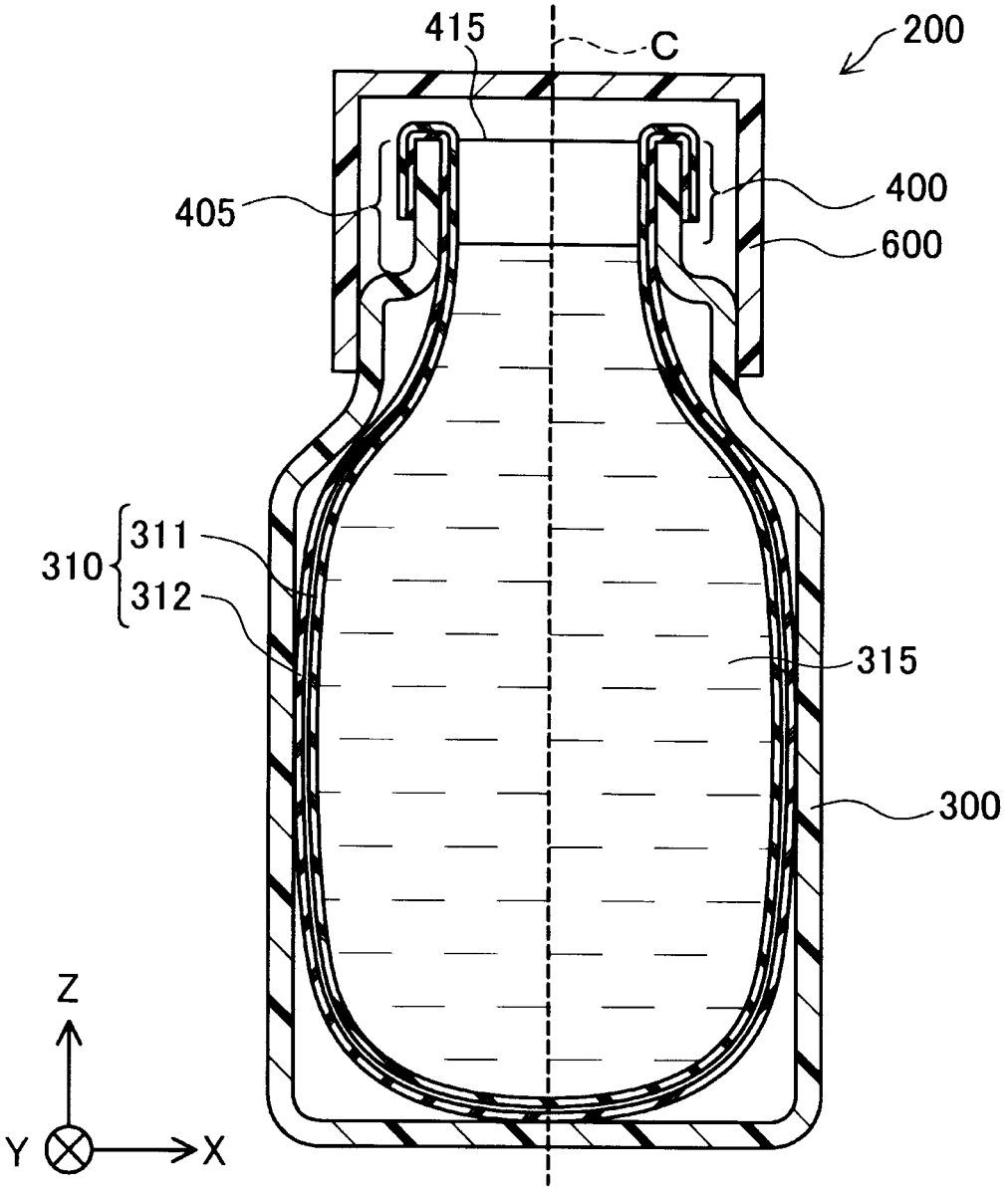
FIG. 3 is a vertical cross-sectional view of the ink supply bottle in an initial state.

FIG. 3 is a vertical cross-sectional view of the ink supply bottle 200 in an initial state. FIG. 3 illustrates the cross section containing the central axis C. As illustrated in FIG. 3, the bottle body 300, which houses the ink bag 310, has a bottleneck 405 with an exit opening at its end.

In this embodiment, the ink bag 310, which contains an ink 315, includes a first ink sub-bag 311 and a second ink sub-bag 312, both of which have enough sizes to be housed in the bottle body 300. The first ink sub-bag 311 and the second ink sub-bag 312 constitute a multilayered structure, in which the first ink sub-bag 311 is disposed inside the second ink sub-bag 312. In addition, only the first ink sub-bag 311 contains the ink 315, as illustrated in FIG. 3, although any of the first ink sub-bag 311 and the second ink sub-bag 312 is configured to contain the ink 315.

Each of the first ink sub-bag 311 and the second ink sub-bag 312 is made of an elastic or stretchable material that contains butyl rubber in this embodiment. Instead of butyl rubber, however, elastic or stretchable material may also contain at least one of butyl rubber, ethylene-propylene rubber, silicone rubber, and thermoplastic elastomer.

The open ends of the first ink sub-bag 311 and the second ink sub-bag 312 are spread out while being layered together. Furthermore, these open ends are folded in the outer radial direction while covering the rim of the bottleneck 405 in the bottle body 300 around its exit opening. Both of the first ink sub-bag 311 and the second ink sub-bag 312 are secured to the rim of the bottleneck 405 by their contractive forces acting on the rim in the inner radial direction.

The ink conduit member 400 is disposed in the bottleneck 405 of the bottle body 300. The ink conduit member 400 is in contact with the inner side of the first ink sub-bag 311 and seals the opening of the first ink sub-bag 311, thereby forming the ink outlet 415. The ink conduit member 400 has a valve structure including a valve body 440, details of which will be described later.

Figure 4:
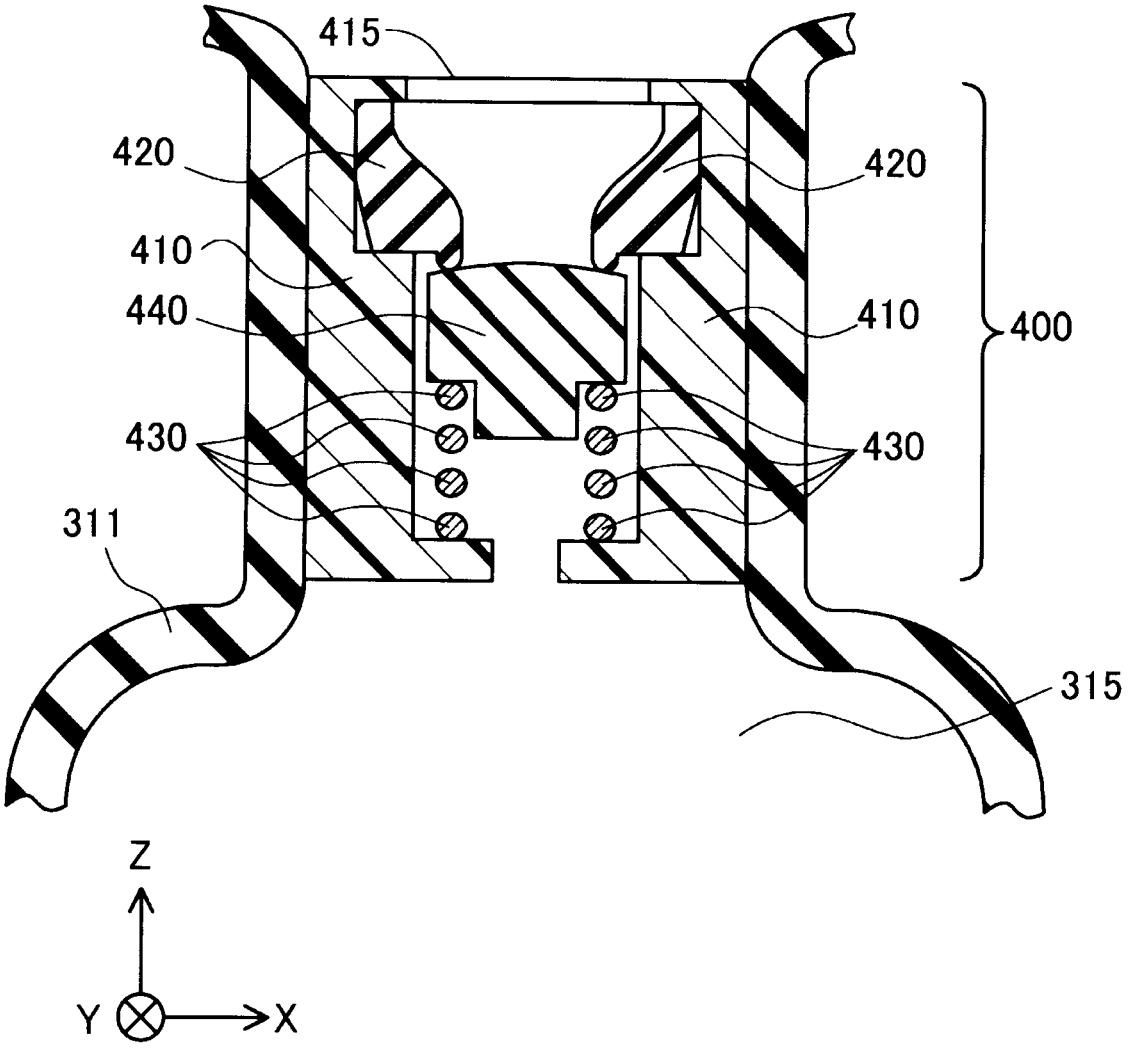
FIG. 4 is an enlarged, vertical cross-sectional view of the ink conduit member.

FIG. 4 is an enlarged, vertical cross-sectional view of the ink conduit member 400, which includes an ink supply passage part 410, a seal member 420, a coil spring 430, and the valve body 440.

The ink supply passage part 410, which may be made of polypropylene, has a hollow, substantially cylindrical shape. The end of the ink supply passage part 410 in the +Z direction serves as the ink outlet 415. In this embodiment, the central axis of the ink outlet 415 coincides with the central axis C of the ink supply bottle 200. More specifically, the central axis of the ink outlet 415 is formed of a line that passes through the center of the ink outlet 415 and extends along a line normal to a virtual plane parallel to the end face of the ink outlet 415. Alternatively, the central axis of the ink outlet 415 may deviate from the central axis C. The ink supply passage part 410 is disposed in contact with the inner side of the first ink sub-bag 311. The ink supply passage part 410 is fitted into the first ink sub-bag 311 and secured thereto by the contractive force of the first ink sub-bag 311. The inner space of the ink supply passage part 410 serves as the passage of the ink 315. Alternatively, the ink supply passage part 410 may be securely bonded to the first ink sub-bag 311. It should be noted that the material of the ink supply passage part 410 is not limited to polypropylene; alternatively, it may be any other resin.

As illustrated in FIG. 4, the seal member 420 is disposed inside the ink supply passage part 410 at its end in the +Z direction. The seal member 420 may be formed of an elastic ring. The size of the seal member 420 in the radial directions becomes larger toward the −Z side, but it is smallest on the −Z side. The seal member 420 may be made of rubber. The seal member 420 serves as a valve seat member that blocks the ink outlet 415 together with the valve body 440 pressed against the seal member 420 unless an ink supply needle (not illustrated) is inserted into the ink conduit member 400 through the ink outlet 415. When the ink supply needle is inserted into the ink conduit member 400 through the ink outlet 415, the valve body 440 is displaced away from the seal member 420 against the biasing force of the coil spring 430, thereby opening the ink outlet 415. Details of the coil spring 430 will be described later.

The coil spring 430 is disposed inside the ink supply passage part 410 at its end in the −Z direction. The coil spring 430 is a biasing member that biases the valve body 440 toward the seal member 420; details of the valve body 440 will be described later. The valve body 440 blocks the passage of the ink 315 unless the ink supply needle is inserted into the ink conduit member 400 through the ink outlet 415, as illustrated in FIG. 4.

The valve body 440 is disposed between the seal member 420 and the coil spring 430 inside the ink supply passage part 410. Formed between the valve body 440 and the inner surface of the ink supply passage part 410 is a gap, which serves as the passage of the ink 315. The portion of the valve body 440 on the −Z side which is smaller than the other portion is inserted into the inner space of the coil spring 430. The valve body 440 is biased from the inside of the first ink sub-bag 311 in the direction in which the ink outlet 415 is closed. The side of the valve body 440 in the outer radial direction blocks the passage of the ink 315 by the biasing force of the coil spring 430. In this way, the valve body 440 suppresses the ink 315 from accidentally flowing out from the inside of the first ink sub-bag 311. The valve body 440 is preferably made of an elastomer having an elastic property such as silicone rubber; the ink supply bottle 200 may be made of a thermoplastic resin such as polyethylene or polypropylene.

The ink supply passage part 410 has insertion parts (not illustrated) formed around the ink outlet 415. These insertion parts are inserted into respective depressions formed in each ink tank 130 near its ink-passage-inlet member 132. In this embodiment, the insertion parts are arranged so as to face each other across the ink outlet 415 and have symmetric shapes with respect to the point on the central axis C of the ink supply bottle 200. Likewise, the depressions that are formed in each ink tank 130 around its ink-passage-inlet member 132 have symmetric shapes with respect to the central point on the ink-passage-inlet member 132. When refilling the ink 315 in an ink tank 130 through an ink supply bottle 200, the user has only to insert the insertion parts of the ink supply bottle 200 into the respective depressions in the ink tank 130 around the ink-passage-inlet member 132. In this case, the user may place the ink supply bottle 200 in any of two orientations, which are different by 180°. This configuration helps the user keep the ink supply bottle 200 stable during the refilling of the ink 315. It should be noted that the above insertion parts are optional.

As illustrated in FIG. 3, the cap 600 is attached to the end of the ink conduit member 400. The cap 600 is a cup-like shape with a bottom surface facing in the +Z direction when the cap 600 is attached to the ink conduit member 400. The cap 600 acts as a protector for the ink conduit member 400.

Figure 5:
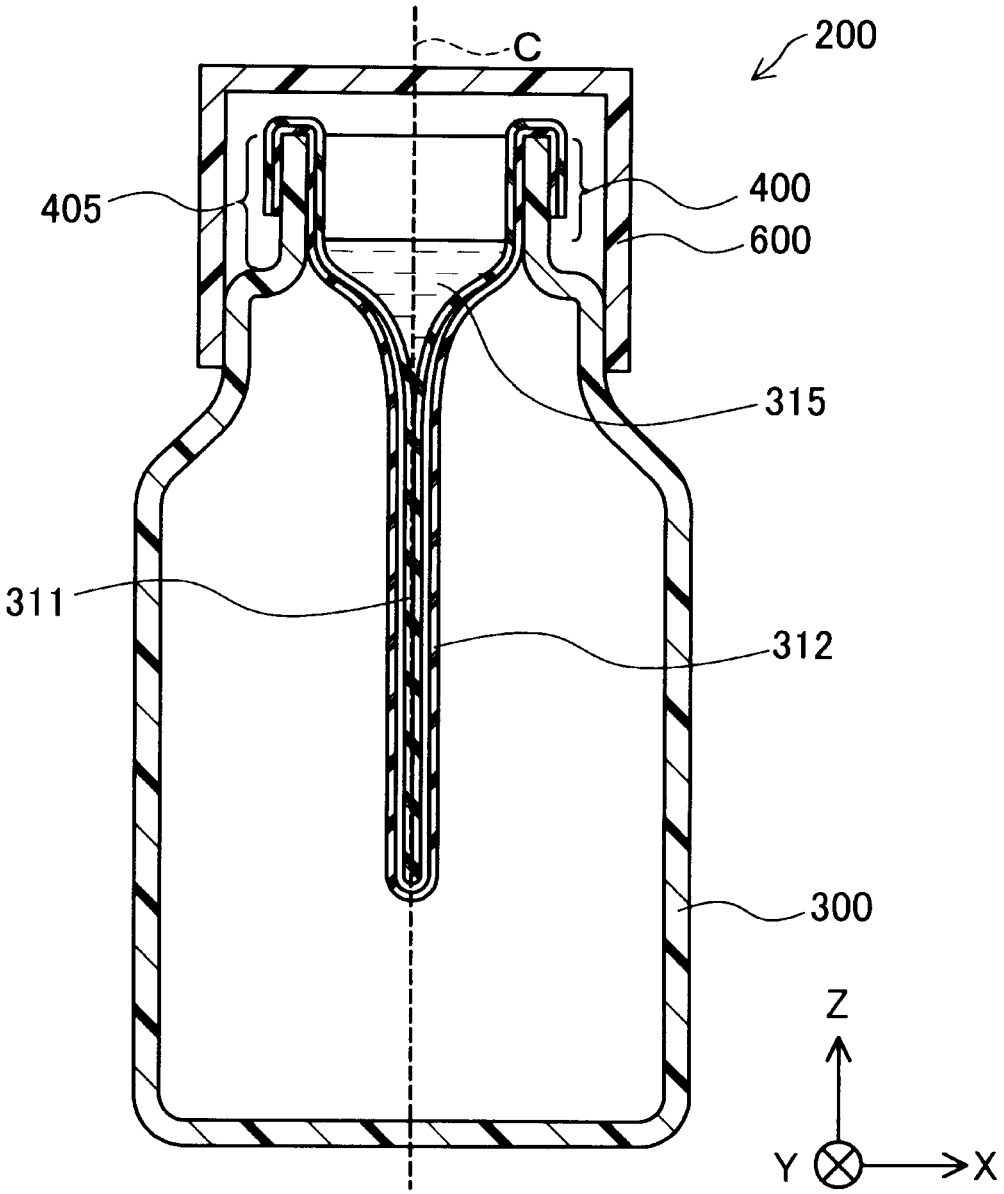
FIG. 5 is a vertical cross-sectional view of the ink supply bottle that has been used.

FIG. 5 is a vertical cross-sectional view of the ink supply bottle 200 that has been used. In FIG. 5, the ink 315 inside the first ink sub-bag 311 has been run out, so that the ink bag 310 shrinks on the whole and can be removed from the bottle body 300. In this case, when the user pulls out the ink conduit member 400 from the bottle body 300, both the ink conduit member 400 and the first ink sub-bag 311 into which the ink conduit member 400 is inserted stick out from the bottle body 300.

Figure 6:
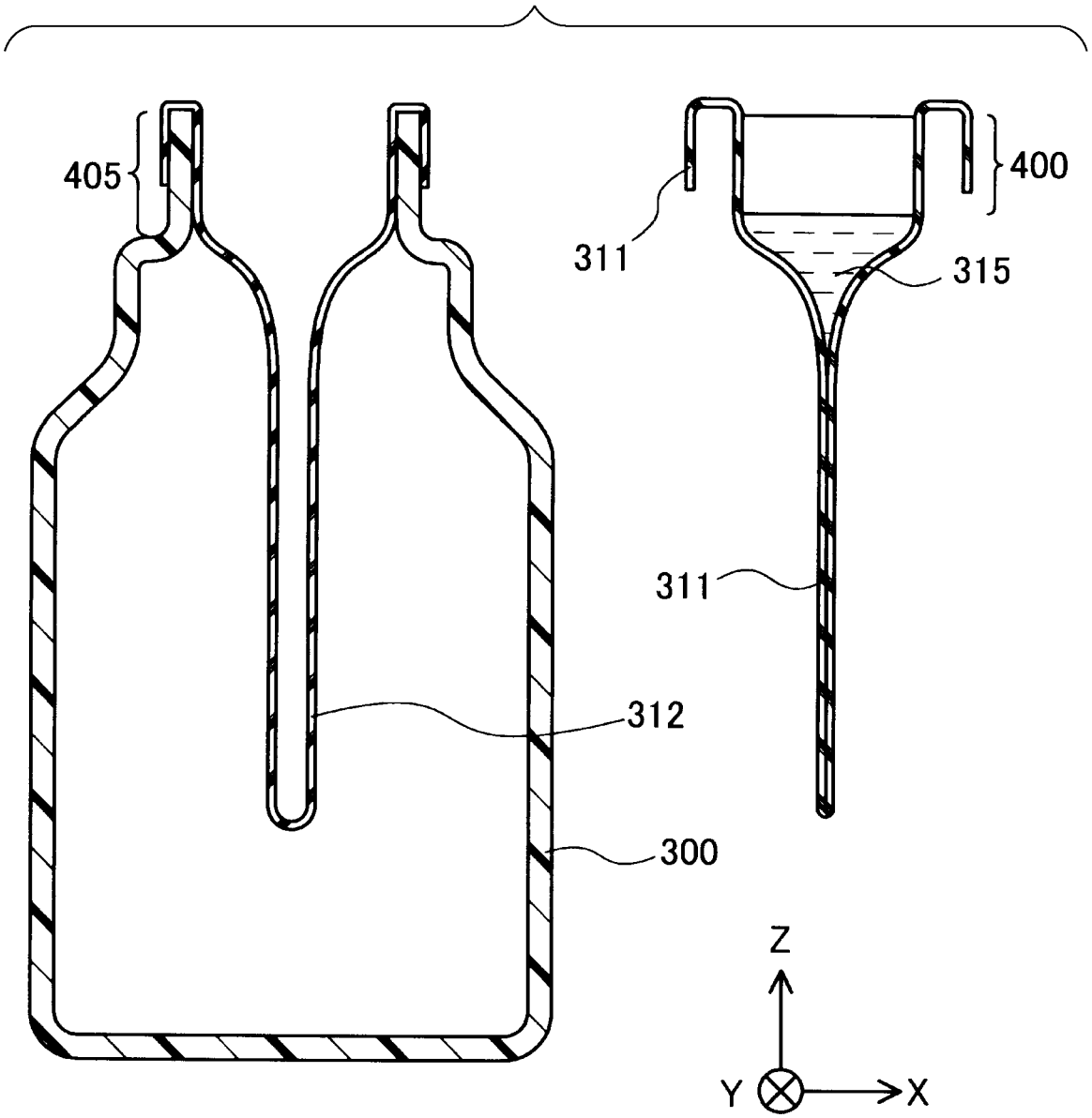
FIG. 6 is a vertical cross-sectional view of the first ink sub-bag and the bottle body, both of which are separated from each other.

FIG. 6 is a vertical cross-sectional view of the first ink sub-bag 311 and the bottle body 300, both of which are separated from each other. After the ink 315 has been run out, the user needs to remove the first ink sub-bag 311 from the bottle body 300. In this case, whereas the ink 315 adheres to the first ink sub-bag 311, it does not adhere to both the bottle body 300 and the second ink sub-bag 312. Therefore, it is possible to reuse both the bottle body 300 and the second ink sub-bag 312. In addition, it is also possible to reuse the cap 600 (see FIG. 5) unless the ink 315 adheres thereto. Thus, the user has only to remove the first ink sub-bag 311 and the ink conduit member 400 from the bottle body 300 and to discard them.

Figure 7:
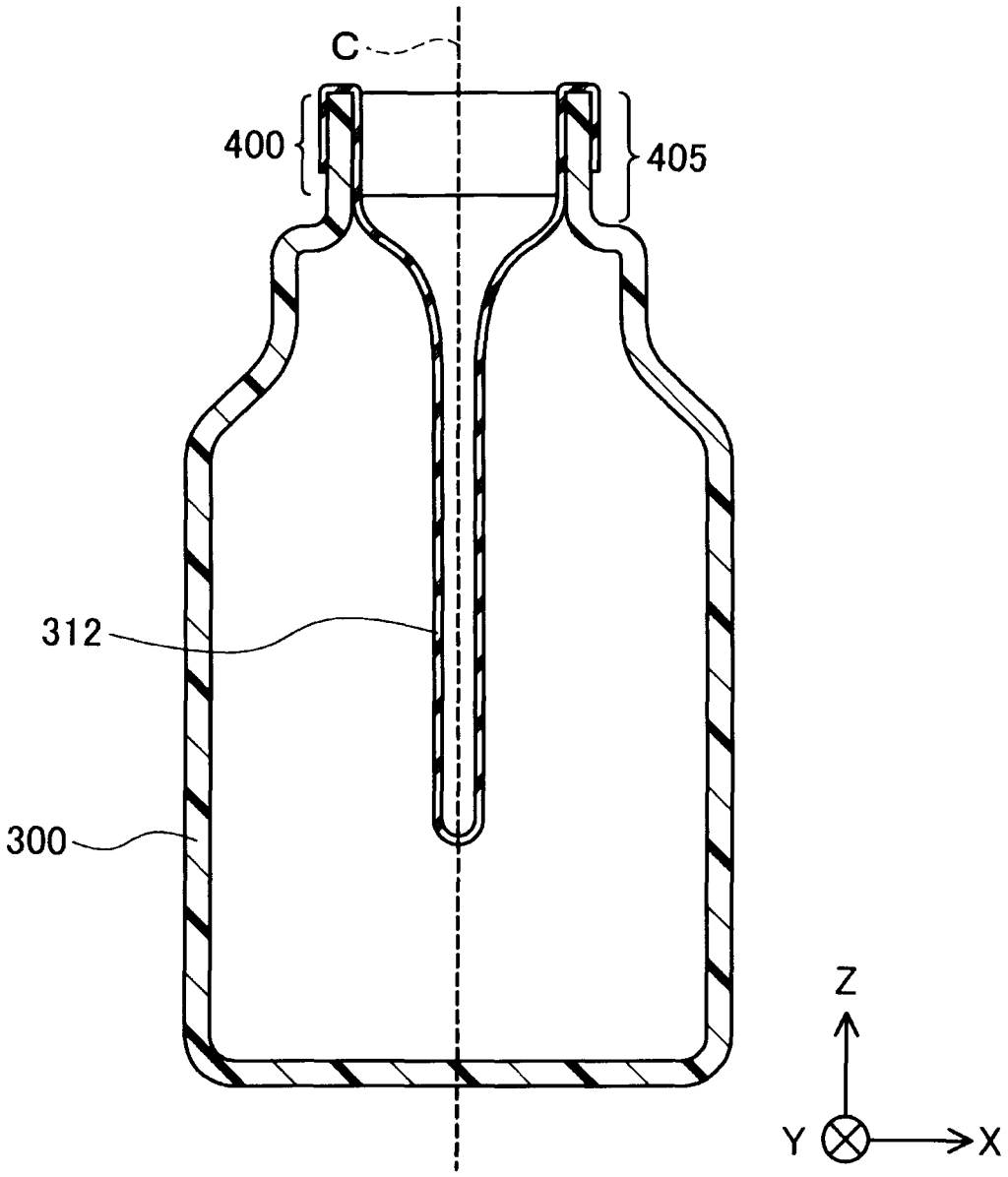
FIG. 7 is a vertical cross-sectional view of the second ink sub-bag to which a new ink conduit member is secured.

FIG. 7 is a vertical cross-sectional view of the second ink sub-bag 312 to which a new ink conduit member 400 is secured. The ink conduit member 400 is securely inserted into the bottleneck 405 with the second ink sub-bag 312 therebetween. In this case, the user needs to fill a new ink in the second ink sub-bag 312. The ink that has been newly filled in the second ink sub-bag 312 will be supplied to an ink tank 130. In this way, it is possible to reuse the bottle body 300 and the second ink sub-bag 312 to which no ink adheres.

Herein, the bottle body 300 in this embodiment corresponds to a bottle.

In the first embodiment, as described above, an ink supply bottle 200 includes a first ink sub-bag 311 and a second ink sub-bag 312, each of which is made of an extendable material. Every time the ink is supplied from the ink supply bottle 200 to a printer 100, both the first ink sub-bag 311 and the second ink sub-bag 312 shrink. After the ink has been run out, both the first ink sub-bag 311 and the second ink sub-bag 312 can be removed from a bottle body 300 of the ink supply bottle 200. In this case, it is possible to reuse the bottle body 300 because no ink adheres thereto. This configuration provides the ink supply bottle 200 with good reusability, thereby enabling waste reduction.

In the first embodiment, the ink supply bottle 200 further includes an ink conduit member 400 with a valve structure including a valve body 440. This valve structure including the valve body 440 seals the opening of the first ink sub-bag 311 to close the ink outlet 415. Thus, this valve structure successfully suppresses an ink 315 from accidentally flowing out from the first ink sub-bag 311 via the ink outlet 415 even when the shrinking first ink sub-bag 311 stresses the ink 315.

Both of the first ink sub-bag 311 and the second ink sub-bag 312 constitute a multilayered structure, in which one of the first ink sub-bag 311 and the second ink sub-bag 312 is disposed inside the other. First, the first ink sub-bag 311 disposed inside the second ink sub-bag 312 contains the ink 315. Then, after the ink 315 has been run out, the first ink sub-bag 311 is removed from the bottle body 300 and discarded. Next, a new ink 315 is filled in the second ink sub-bag 312. In this case, the number of times that the bottle body 300 can be reused depends on how many ink sub-bags are disposed inside a bottle body 300. Moreover, after the first ink sub-bag 311 has been used, the user has only to pull out the first ink sub-bag 311 from the bottle body 300 so that the first ink sub-bag 311 is removed from the bottle body 300 and the second ink sub-bag 312 is thereby ready for use. Thus, this configuration provides good usability to the user.

The open ends of the first ink sub-bag 311 and the second ink sub-bag 312 are layered together and folded in an outer radial direction of bottle body 300 while covering a rim of a bottleneck 405 in the bottle body 300 around its exit opening. In this case, both of the first ink sub-bag 311 and the second ink sub-bag 312 are secured to the bottle body 300 due to the contractive forces that the first ink sub-bag 311 and the second ink sub-bag 312 apply to the bottleneck 405 in an inner radial direction. Thus, the user can easily attach both the first ink sub-bag 311 and the second ink sub-bag 312 to the bottle body 300. Furthermore, after the ink 315 has been run out, the user can also easily remove both the first ink sub-bag 311 and the second ink sub-bag 312 from the bottleneck 405 of the bottle body 300 by pulling out the ink conduit member 400 from the bottle body 300. In which case, the first ink sub-bag 311 and the second ink sub-bag 312 are removed together with the ink conduit member 400.

B. Second Embodiment

Figure 8:
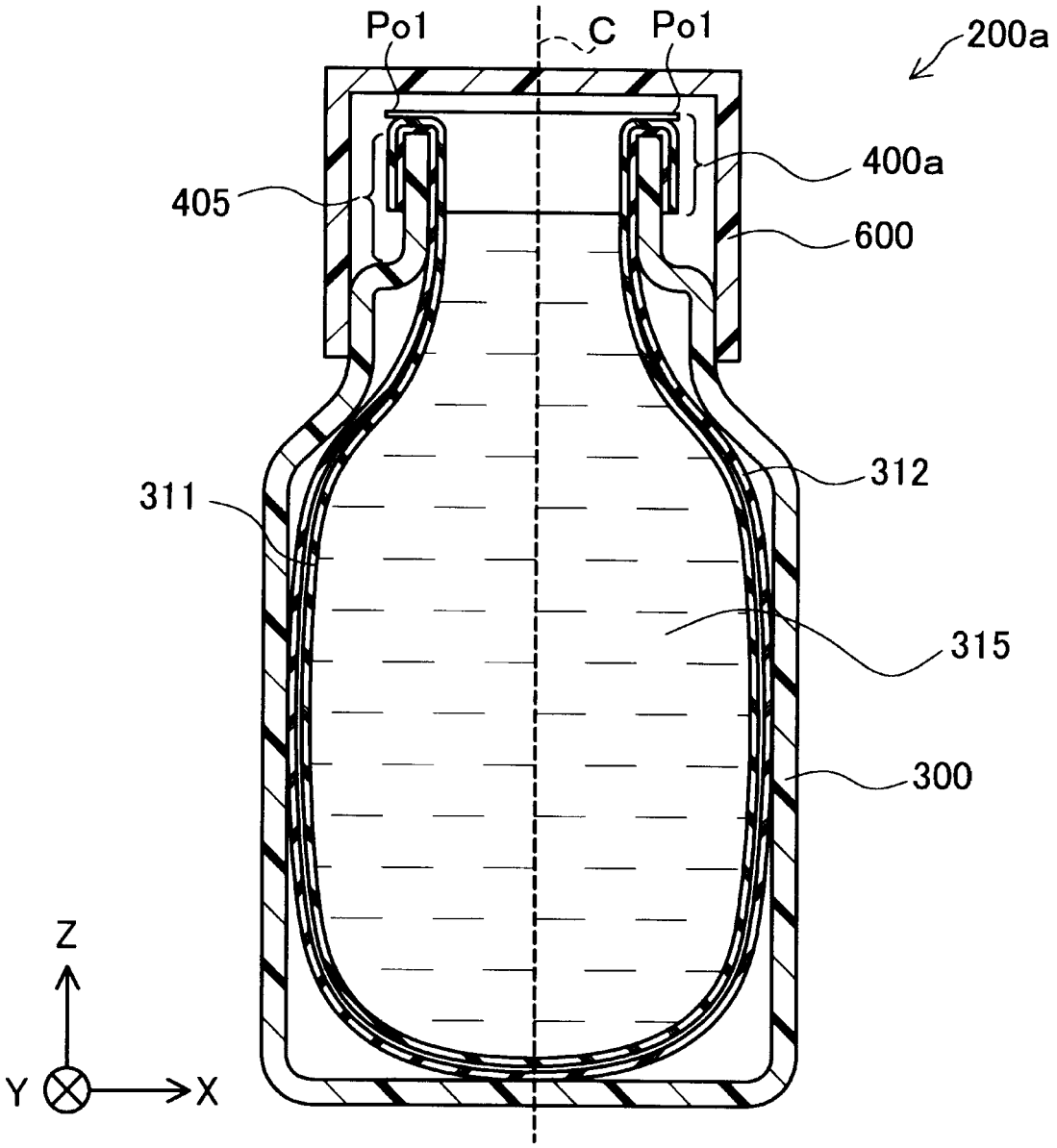
FIG. 8 is a vertical cross-sectional view of an ink supply bottle in a regular posture, according to a second embodiment of the present disclosure.

FIG. 8 is a vertical cross-sectional view of an ink supply bottle 200*a* in a regular posture, according to a second embodiment of the present disclosure. A configuration of the ink supply bottle 200*a*, illustrated in FIG. 8, in the second embodiment differs from that of the ink supply bottle 200 in the foregoing first embodiment because the end of an ink conduit member 400*a* sticks out in an outward direction from a bottleneck 405 of a bottle body 300. Except for this, the configuration of the ink supply bottle 200*a* is substantially the same as that of the ink supply bottle 200 in the first embodiment. Thus, the same components are given the identical reference numerals and will not be described in detail below.

As illustrated in FIG. 8, the end of the ink conduit member 400*a* in the +Z direction, such as the end of the ink supply passage part 410, sticks out from the bottleneck 405 in the outward direction. Herein, the outward direction refers to the direction from the bottleneck 405 to a cap 600 along the central axis C. The end of the ink conduit member 400*a* forms a flange Pol, which protrudes out not only in the outward direction from the bottleneck 405 but also in an outer radial direction from the bottleneck 405 of the bottle body 300. The user can pick up the flange Pol with his/her fingers when removing the ink conduit member 400*a* from the bottle body 300 or when attaching the ink conduit member 400*a* thereto. Thus, the ink supply bottle 200*a* has a simple configuration but enables a user to remove/attach the ink conduit member 400*a* from or to the bottle body 300.

In the second embodiment, as described above, an ink supply bottle 200*a* includes a flange Pol at the end of an ink conduit member 400*a*. A user can easily remove/attach the ink conduit member 400*a* from or to a bottle body 300 by picking up the flange Pol with his/her fingers. Thus, the ink supply bottle 200*a* has a simple configuration but enables a user to remove/attach the ink conduit member 400*a* from or to the bottle body 300.

C. Other Embodiments (C1) In the foregoing first and second embodiments, an outer surface of a second ink sub-bag 312 may be at least partly securely bonded to an inner surface of a bottle body 300. This configuration can suppress an ink from accidentally flowing out without a valve structure, in which case the valve structure including the valve body 440 does not have to be provided.

(C2) In the foregoing first and second embodiments, two or any other plural number of ink sub-bags may be provided to constitute an ink bag 310.

(C3) In the foregoing second embodiment, the end of an ink conduit member 400*a* does not necessarily have to form a flange Pol. Alternatively, the ink conduit member 400*a* may stick out only in an axial direction.

The present disclosure is not limited to the foregoing first and second embodiments and may be modified without departing from the spirit. For example, the present disclosure may be implemented by an aspect that will be described below. The technical features of the foregoing first and second embodiments which are equivalent to those described in the aspect may be replaced or combined as appropriate in order to address some or all problems in the present disclosure or achieve some or all effects of the present disclosure. Moreover, those technical features may be deleted as appropriate unless they are described as being essential herein.

(1) According to an aspect of the present disclosure, an ink supply bottle from which ink is to be supplied to a printer includes: an ink bag that contains the ink; a bottle unit that houses the ink bag and that has a bottleneck with an exit opening; and an ink conduit member disposed in the bottleneck of the bottle. The ink conduit member is in contact with an inner side of the ink bag and seals an opening of the ink bag to form an ink outlet. The ink bag is made of an elastic or stretchable material. Every time the ink is supplied from the ink supply bottle to the printer, the ink bag shrinks. After the ink has been run out, the ink bag can be removed from the bottle unit. This configuration successfully provides the ink supply bottle with good reusability, thereby enabling waste reduction.

(2) In the ink supply bottle of the aspect, the elastic or stretchable material may contain at least one of butyl rubber, ethylene-propylene rubber, silicone rubber, and thermoplastic elastomer.

(3) In the ink supply bottle of the aspect, the ink conduit member may have a valve structure including a valve body that is biased from inside of the ink bag in a direction in which the ink outlet closes. In this ink supply bottle, when the shrinking ink bag attempts to eject the ink to the outside, the valve structure including the valve body blocks the flow-out of the ink by closing the ink outlet. Thus, this configuration successfully suppresses the ink from accidentally flowing out to the outside via the ink outlet due to the contractive force of the ink bag.

(4) In the ink supply bottle of the aspect, an outer surface of the ink bag may be at least partly securely bonded to an inner surface of the bottle. This ink supply bottle does not require the valve structure including the valve body because the ink bag does not shrink. Thus, the ink supply bottle successfully suppresses the ink from accidentally flowing out to the outside via the ink outlet without the valve structure.

(5) In the ink supply bottle of the aspect, the ink bag may include a plurality of ink sub-bags that constitute a multilayered structure, in which one of the ink sub-bags is disposed inside another. In this case, the number of times that the ink supply bottle can be reused depends on how many ink sub-bags are disposed inside the bottle unit. Moreover, to make a new ink bag ready for use, the user has only to pull out the used ink sub-bag from the bottle. This configuration provides good usability to the user.

(6) In the ink supply bottle of the aspect, open ends of the ink sub-bags may be layered together and folded in an outer radial direction of the bottle unit while covering a rim of the bottleneck around the aperture. The open ends of the ink sub-bags may be secured to the bottleneck by contractive force that the ink sub-bags apply to the bottleneck in an inner radial direction of the bottle unit. In this ink supply bottle, the ink bag applies the contractive force to the bottle unit in the inner radial direction. Therefore, the user can easily attach the ink bag to the bottle unit. Since the ink bag is secured to the bottleneck of the bottle unit, the user can easily pull out the ink bag from the bottle unit when removing the ink bag after use.

(7) In the ink supply bottle of the aspect, the ink conduit member may be securely pressed to the bottleneck with sandwiching the ink bag therebetween, and an end of the ink conduit member may stick out in an outward direction from the bottleneck. This ink supply bottle has a simple configuration but enables the user to easily remove the ink conduit member from the bottle unit or attach the ink conduit member to the bottle unit.

What is claimed is:

1. An ink supply bottle from which ink is to be supplied to a printer, the ink supply bottle comprising:

an ink bag that contains the ink;

a bottle unit that houses the ink bag and that has a bottleneck with an exit opening; and an ink conduit member disposed in the bottleneck, the ink conduit member being in contact with an inner side of the ink bag and sealing an opening of the ink bag to form an ink outlet, the ink bag being made of an elastic or stretchable material, wherein the ink bag includes a first sub-bag and a second sub-bag, the first sub-bag configured to be removably inserted inside the second sub-bag, and wherein:

when the first sub-bag is inserted inside the second sub-bag, the ink is contained within the first sub-bag without directly contacting the second sub-bag; and after the first sub-bag is removed from the second sub-bag, the ink, when refilled, is contained within and in direct contact with the second sub-bag.

2. The ink supply bottle according to claim 1, wherein the elastic or stretchable material contains at least one of butyl rubber, ethylene-propylene rubber, silicone rubber, and thermoplastic elastomer.

3. The ink supply bottle according to claim 1, wherein the ink conduit member has a valve structure including a valve body, the valve body being biased from inside of the ink bag in a direction in which the ink outlet closes.

4. The ink supply bottle according to claim 3, wherein the ink bag includes a plurality of ink sub-bags, including the first sub-bag and the second sub-bag, that constitute a multilayered structure, one of the ink sub-bags being disposed inside another.

5. The ink supply bottle according to claim 4, wherein open ends of the ink sub-bags are layered together and folded in an outer radial direction of the bottle unit while covering a rim of the bottleneck around the exit opening, and the open ends of the ink sub-bags are secured to the bottleneck by contractive force that the ink sub-bags apply to the bottleneck in an inner radial direction of the bottle unit.

6. The ink supply bottle according to claim 1, wherein an outer surface of the ink bag is at least partly securely bonded to an inner surface of the bottle.

7. The ink supply bottle according to claim 1, wherein the ink conduit member is securely pressed to the bottleneck with sandwiching the ink bag therebetween, and an end of the ink conduit member sticking out in an outward direction from the bottleneck.

* * * * *